United States Patent [19]

Sprenkle

[11] 4,381,130

[45] Apr. 26, 1983

[54] ZERO INSERTION FORCE CONNECTOR FOR INTEGRATED CIRCUIT PACKAGES

[75] Inventor: George J. Sprenkle, Phoenixville, Pa.

[73] Assignee: Burroughs Corporation, Detroit, Mich.

[21] Appl. No.: 192,429

[22] Filed: Sep. 29, 1980

[51] Int. Cl.[3] ..... H01R 13/62

[52] U.S. Cl. ..... 339/74 R

[58] Field of Search ..... 339/17 C, 74 R, 75 R, 339/75 M, 75 MP, 260, 261, 17 CF

[56] References Cited

U.S. PATENT DOCUMENTS

| | | | |
|---|---|---|---|
| 3,325,766 | 6/1967 | Kolb et al. | 339/17 CF |
| 3,538,486 | 11/1970 | Shlesinger, Jr. | 339/74 R |
| 3,634,879 | 1/1972 | Longenecker et al. | 339/17 CF |
| 3,865,457 | 2/1975 | Carter | 339/74 R |
| 3,883,207 | 5/1975 | Tomkiewicz | 339/17 C |

*Primary Examiner*—Joseph H. McGlynn

*Attorney, Agent, or Firm*—Francis A. Varallo; M. L. Young; K. R. Peterson

[57] ABSTRACT

The present disclosure describes a connector or socket having particular application for LSI/VLSI integrated circuit (IC) packages with cylindrical interface pins. The connector is characterized by the ease with which the IC package may be inserted therein or withdrawn therefrom, despite the large number of pins involved. In achieving this result, the connector utilizes a unique contact design wherein two opposing cantilever type spring members include respective contoured fingers for capturing and firmly holding an IC package pin during normal circuit operation. The connector also incorporates one or more contact release plates, each having a plurality of cam-like apertures operatively positioned with respect to the connector contacts. Actuation of a release plate moves each pair of contact spring members toward each other, thereby opening the area enclosed by the fingers and providing substantially zero force package insertion or withdrawal conditions.

10 Claims, 6 Drawing Figures

Fig.1
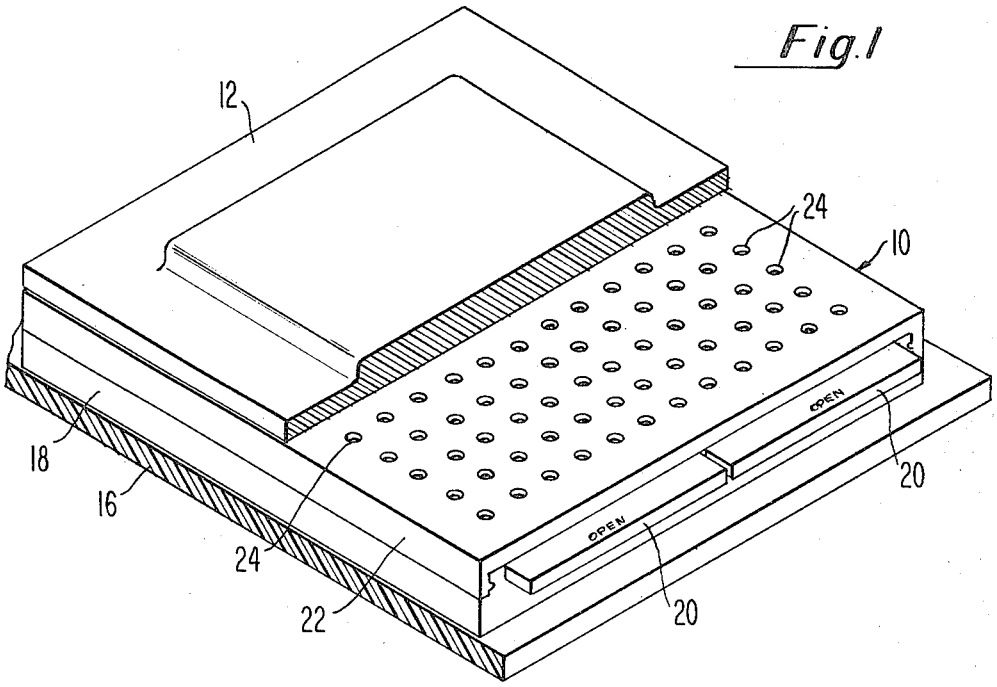
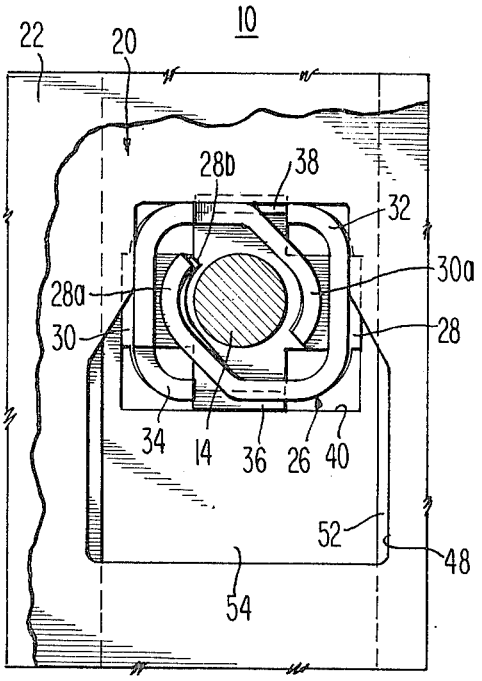
Fig.4
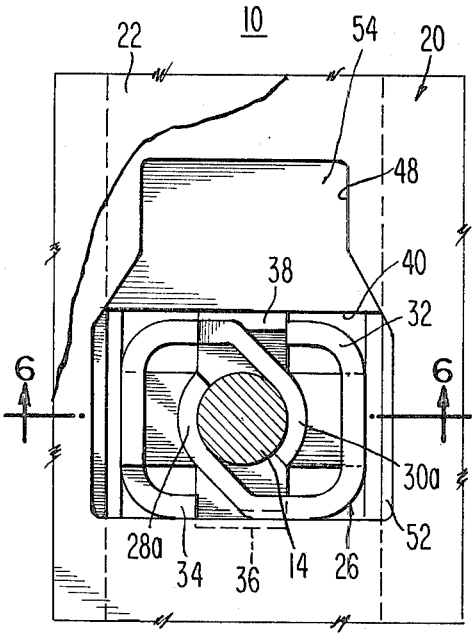
Fig.5

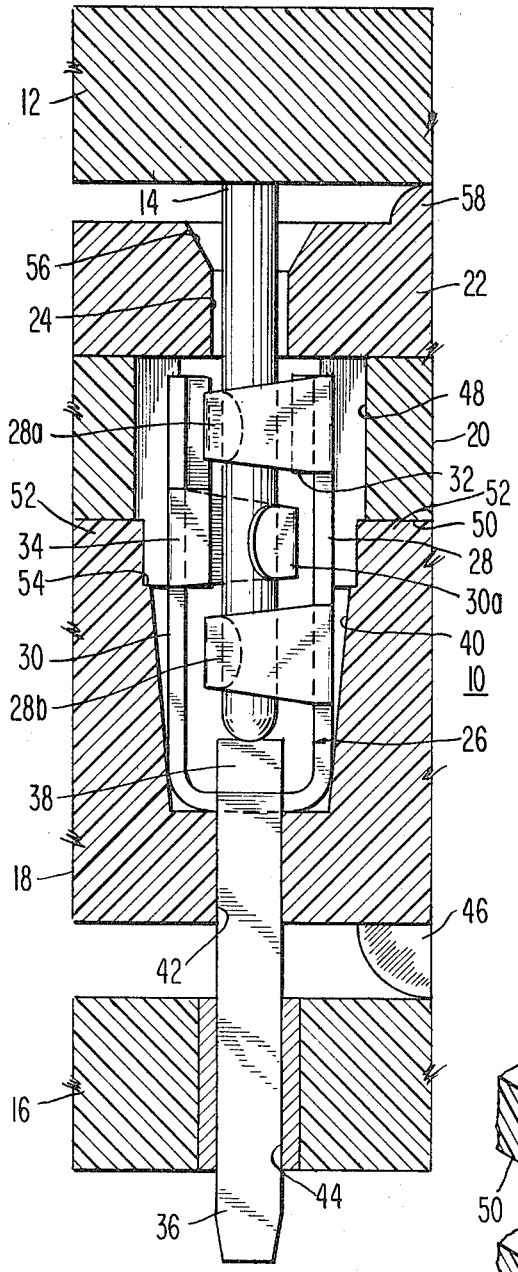
Fig.6
Fig.2
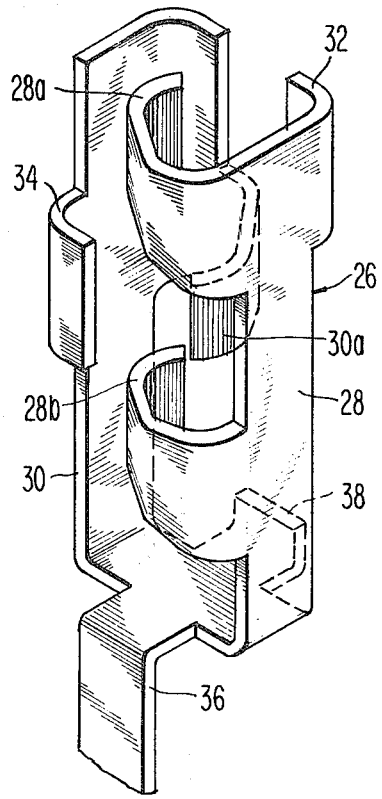
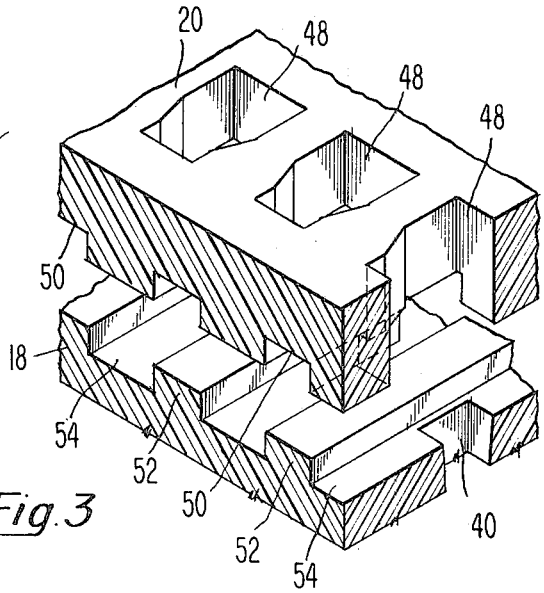
Fig.3

ZERO INSERTION FORCE CONNECTOR FOR INTEGRATED CIRCUIT PACKAGES

BACKGROUND OF THE INVENTION

The electronic industry has an ever increasing need for high density integrated circuit (IC) packages of the LSI/VLSI categories. Such packages may contain over two hundred closely spaced interface, that is, input/output pins. In general, such IC packages are designed to be mounted in a connector or socket. The latter have a plurality of electrical contacts for engaging the IC package pins and for providing an electrical path between the pins and an interconnection medium, such as a printed circuit board. Because of the large number of pins involved and the pressure exerted thereon by the respective connector contacts, an insertion force of large magnitude applied orthogonally to the planar outer surface of the package, is required to seat the latter in the connector. The amount of insertion force required is such as to cause the bowing of the printed circuit board and possible damage thereto. Moreover, the subsequent removal of the IC package from the connector cannot be readily accomplished without the aid of a special extraction tool. An additional problem stemming from the large number of IC interface pins is that perfect registration between the pin locations and the homologous pin-receiving apertures of the connector contacts is required. Even slight deviations in such registration may result in damage to the pins during the insertion process.

In view of the above mentioned difficulties, it is apparent that what is needed is a connector or socket in which, on the one hand, the IC package may be inserted or removed under zero force conditions, but on the other hand, provides the required electrical contact pressure on the IC pins during normal operation. Moreover the connector design should be such as to eliminate the requirement for perfect registration of the IC pins and connector contacts.

The connector of the present invention fills such a need.

SUMMARY OF THE INVENTION

In accordance with the present invention, there is provided a connector or socket capable of providing good electrical contact during circuit operation but having the capability of receiving or releasing an integrated package under zero force conditions. While especially useful in LSI and VLSI applications involving large numbers of package pins, the invention should not be considered limited thereto.

Briefly, the connector comprises a body member having cavities for holding the respective specially designed contacts, one or more contact release plates and a cover member.

Each contact is in effect a pseudo socket in that it has two beam members with contoured fingers to capture the IC package pin, similar to a pin and socket configuration. The fingers are an extension of two opposing cantilever beam-type spring members. The latter are designed to create a pre-load condition when placed in the cavities of the base member, wherein the action of the beam members is in opposition and the finger extensions tend to be driven toward each other.

One or more contact release plates, each comprised of a plurality of cam-like apertures of like number and location with respect to the contacts are positioned over the latter. The cover member which has a plurality of apertures for accepting and guiding the IC package pins into the contact area is then attached to the base member.

Movement of a release plate to the "open" position, pushes each pair of contact beam members toward each other, causing the associated fingers to move away from each other. This action creates the widened zero force pseudo socket referred to previously. The enlarged pin-receiving area also tends to reduce the pin registration tolerances. After the IC package pins have been inserted into the contact area via the cover plate apertures, the contact release plate is moved to the "closed" position. This permits the contact beam members to collapse toward their pre-load position and causes the fingers to trap and enclose the package pins.

Other features of the present invention, including the provision of a contact tail extension for electrical connection to the printed circuit board and the convenience of replacing contacts when necessary, will become apparent in the detailed description of the invention which follows.

BRIEF DESCRIPTION OF THE DRAWINGS

FIG. 1 is a pictorial illustration of a portion of a packaging assembly utilizing the connector of the present invention.

FIG. 2 is a pictorial view of the electrical contact used in the connector.

FIG. 3 is an exploded view illustrating the details of the connector contact release plate and its relationship to the connector base on which it is slidably mounted.

FIG. 4 is a plan view of a unitary segment of the connector with the cover member cut away to illustrate the relationship of the contact of FIG. 2 to an IC package pin when the connector is in its zero force condition indicated by the "open" position of the connector contact release plate in FIG. 1.

FIG. 5 is a plan view of a unitary segment of the connector with the cover member cut away to illustrate the relationship of the contact of FIG. 2 to an IC package pin when the connector is in its operating mode resulting from moving the connector contact release plate to its "closed" position.

FIG. 6 is a section view taken along lines 6—6 of FIG. 5 to further illustrate the engagement of the contact with the IC package pin in the "closed" position.

DESCRIPTION OF THE PREFERRED EMBODIMENT

In FIG. 1 there is depicted a fragment of a packaging assembly comprised of the connector 10 of the present invention, an integrated circuit package 12 having a plurality of interface pins 14 (as seen, for example, in FIGS. 5 and 6 inserted into the connector 10, and a printed circuit board 16 for mounting connector 10 and thereby providing electrical interconnections. The connector 10 includes a base 18, a pair of contact release plates 20 shown in the "open" or contact release position, and a cover 22 having a plurality of apertures 24 visible by virtue of the cutaway portion of the IC package 12, for receiving pins 14.

FIG. 2 illustrates the contact design employed in connector 10. Each contact 26 comprises a pair of opposing cantilever beam-type members 28 and 30 joined at one extremity. Beam member 28 includes a pair of longitudinally spaced-apart fingers 28*a* and 28*b* which are arcuately contoured and project laterally from the forward edge of the generally planar surface of the beam member 28. Beam member 30, on the other hand, has a single arcuately contoured finger 30*a* which is longitudinally disposed in the space between the fingers 28*a* and 28*b* of beam member 28, and projects from the rearward edge of the planar surface of beam member 30. The contour of all of the fingers is such that they are oriented in the same sense or direction. The tab-like extensions 32 and 34 on beam members 28 and 30 respectively provide added stiffness to the material of the latter. The contact 26 further includes at one side of the common extremity of the beam members, a tail section 36 for establishing an electrical path between the contact 26 and the printed circuit board 16. On the other side of the last mentioned extremity, a tang 38 is provided to aid in the retention of the contact 26 within the connector base 18. The physical location of the contact elements within the connector and their function will become more apparent in the description presented hereinafter.

The construction of the connector of the present invention is best appreciated with reference to FIGS. 3–6. As indicated in FIGS. 3 and 6, the connector base 18 is formed with a plurality of cavities 40, one of which is illustrated, for holding the contacts 26. Assuming that only the connector base 18 is present, the initial condition of a contact 26 is that it is slightly underformed such that upon insertion into base cavity 40 the beam members 28 and 30 collapse toward the tapered sides of the cavity. This action creates a pre-load condition with the action of the beam members 28, 30 opposing each other and the associated fingers 28*a*, 28*b* on beam member 28 being drawn toward finger 30*a* of beam member 30. A slot 42 in the base member permits the tail 36 of contact 26 to pass therethrough and subsequently to be inserted in a hole 44 in the printed circuit board 16 and to be soldered in place. The tang 38 is designed to provide interference with the cavity wall and to prevent the contact from inadvertent back out. The surface of the base 18 which lies adjacent that of the printed circuit board 16 may be formed with a plurality of protuberances 46. The latter cause a space to be provided between the two surfaces such that they may be cleaned of solder flux and other undesirable substances.

The next element to be considered in the fabrication of connector 10 is the contact release plate 20. As seen in FIG. 1 more than one contact release plate 20 may be used in a connector. Reference to FIG. 3 indicates that the contact release plate 20 contains a plurality of cam-like apertures 48 which are wide at one extremity and have a tapered intermediate section which leads to a narrowed opposite extremity. After the contacts 26 have been loaded into the cavities 40 of the base 18, the contact release plate 20 is placed over the contacts such that each contact 26 appears within an aperture 48. The contact release plate 20 is slidably mounted within the base by virtue of grooves 50 in the underside of the former. Each groove 50 accommodates a rib-like member 52 formed in the base 18. The release plate 20 further rests upon the planar surfaces 54 on either side of the rib-like members 52.

Completing the fabrication of connector 10, a cover 22 is snapped onto base 18 utilizing interference type retention as indicated in FIG. 1. The cover 22 includes a plurality of apertures 24 homologously arranged with respect to the contacts 26. As seen particularly in FIG. 6, each aperture 24 has a beveled lead-in surface 56 to facilitate the entrance and guidance of an IC package pin 14 to the pin-receiving area encompassed by the contact fingers 28*a*, 28*b* and 30*a*. A number of selectively placed standoffs 58 may be formed on the outer surface of the cover 22 to prevent the latter from coming into complete surface contact with the pin-attaching surface of the IC package 12. This arrangement has the effect of preventing contaminants for example, from the brazing of nail head type pins to the surface of the IC package, from migrating to the connector contacts.

After the connector 10 has been assembled, it is mounted on the printed circuit board 16 by inserting the contact tails 36 into corresponding apertures 44 in the board 16 and soldering them in place.

With reference to the plan view of FIG. 4, the connector is readied to receive the integrated circuit package by sliding the contact release plates 20 to the "open" or release position, as seen in FIG. 1. Movement of the contact release plates along the rib-like members 52 in the connector base 18 in a plane parallel to the upper and lower surfaces of the connector, causes the walls of the narrowed extremity of the aperture 48 to squeeze the contact beam members 28 and 30 toward each other, thereby opening the opposing fingers 28*a*, 28*b* and 30*a*. This action results in a widened and zero insertion force pseudo socket. The use of more than one release plate 20, actuated sequentially, minimizes the forces required to move the plates to the desired position. The IC package pins 14 may now be inserted through apertures 24 in the cover 22, into the contact area without touching the fingers 28*a*, 28*b* and 30*a* of the contacts 26.

After the IC package 12 is fully seated on top of the connector 10, the contact release plates 20 are actuated to the "closed" or operating position. With reference to FIGS. 5 and 6, the cam-like apertures 48 of the contact release plate 20 are moved to bring their wide extremities into the vicinity of the contacts 26 such that the contact beam members 28 and 30 are no longer engaged by the walls defining aperture 48. The beam members 28 and 30 spring back toward the respective opposite sides of cavity 40, and are restrained from contacting the latter, because of the entrapment and enclosure of the IC package pins 14 by the fingers 28*a*, 28*b* and 30*a*. The angular movement of the beam members and their finger extensions, cause a slight wiping action as pressure is brought to bear on the pins, thereby insuring good electrical continuity between contact 26 and pin 14. The IC package 12 is now ready for operation.

Subsequently, if it is desired to remove the package 12 from the connector 10, the contact release plates 20 are again actuated to their "open" position, and the package may be extracted without having to overcome any contact pressure on the pins 14.

Should a contact 26 need to be replaced, the design of the connector 10 is such that the replacement is readily accomplished. First, the contact tail 36 is unsoldered from the printed circuit board 16. Then, after the connector cover 22 and the contact release plates 20 have been removed, the contact 26 may be pulled out of its cavity 40 in the base 18. A new contact may then be inserted in the cavity and its tail soldered to the printed circuit board.

Although not shown in the drawing, the various elements in the packaging assembly of FIG. 1 may be keyed to one another. For example, by omitting a package pin and a corresponding contact in the connector at one corner of the assembly, the connector 10 will be keyed to the printed circuit board 16, and the IC package 12 will be keyed to the connector 10.

In conclusion there has been disclosed a connector well suited for present day technology, including VLSI circuit packages. It should be apparent that depending upon the particular application, changes and modifications of the connector may be required. Such changes and modifications insofar as they are not departures from the true scope of the invention are intended to be covered by the following claims.

What is claimed is:

1. A zero insertion force connector for receiving the interface pins of an integrated circuit package comprising:

a plurality of electrical contacts, each of said contacts being comprised of a pair of opposing cantilever beam-type members joined at one end to form a common extremity, each of said last mentioned members having at least one finger extension contoured to engage the surface of an interface pin during operation of the integrated circuit package, the finger extensions of the respective beam-type members defining a pin-receiving area therebetween, a base having a plurality of cavities for receiving respectively said plurality of electrical contacts, said cavities having a pair of opposing tapered walls, said electrical contacts being formed such that upon installation in said cavities, said beam-type members tend to move respectively toward said tapered walls, causing the finger extensions to move toward each other and to restrict said pin-receiving area, at least one contact release plate having a plurality of cam-like apertures, means for slidably mounting said contact release plate within said base, said cam-like apertures encompassing respectively said plurality of electrical contacts, the movement of said contact release plate to an "open" position causing the opposite surfaces at one extremity of each of said cam-like apertures to contact the respective beam-type members of a contact and to squeeze them toward each other, thereby causing said finger extensions to move apart, said finger extensions substantially encompassing an interface pin inserted within said pin-receiving area, movement of said contact release plate to a "closed" position permitting said beam-type members to move away from each other without contacting the opposite surfaces at the other extremity of each of said cam-like apertures, thereby causing said finger extensions to move toward each other and to grip the surface of said interface pin, a cover member disposed over said contact release plate and affixed to said base in a manner to prevent its movement relative thereto, said cover member having a plurality of apertures homologously positioned with respect to the longitudinal center lines of the pin-receiving area of said contacts, the dimensions of each of said apertures providing an exact fit with respect to the cross sectional dimensions of said interface pin, said last mentioned apertures directing each of said interface pins to enter the central portion of said pin-receiving area when said integrated circuit package is mounted in said connector.

2. A connector as defined in claim 1 further characterized in that said pair of cantilever-type beam members include respective generally planar sections having homologous first and second edges, the finger extension of a first of said pair of members projecting from the first edge of its planar section in an initial approximately orthogonal orientation with respect to the last mentioned section and having its extremity curved back within said pin-receiving area toward the section, the finger extension of the second of said pair of members projecting from the second edge of its planar section in an initially orthogonal orientation with respect to the last mentioned section and having its extremity curved back within said pin-receiving area toward the section.

3. A connector as defined in claim 2 further characterized in that said plurality of cavities and their associated contacts are arranged in rows and columns, said means for slidably mounting said contact release plate within said base includes a plurality of rib-like members disposed respectively between adjacent columns of said cavities, and a plurality of grooves in said contact release plate for accommodating said rib-like members, said contact release plate further having projecting surfaces adjacent said cam-like apertures, said last mentioned surfaces resting upon planar surfaces in said base adjacent said cavities.

4. A connector as defined in claim 3 further characterized in that said first of said pair of beam-type members includes a pair of longitudinally spaced-apart, arcuately contoured finger extensions and the second of said beam-type members includes a single arcuately contoured finger extension longitudinally disposed in the space between said last mentioned pair of spaced-apart finger extensions of said first of said pair of beam-type members.

5. A connector as defined in claim 4 further characterized in that each of said cam-like apertures of said contact release plate has a wide generally rectangular opening at one extremity thereof, and a tapered intermediate section leading to a relatively narrow generally rectangular opening at the opposite extremity thereof.

6. A connector as defined in claim 5 wherein each of said plurality of contacts includes a tail section originating on one side of said common extremity of said beam-type members and extending generally along a longitudinal axis in a direction opposite to that of said beam-type members, each of said cavities having a slot for permitting said tail section to penetrate said base and to be accessible for electrical interconnections external to said connector.

7. A connector as defined in claim 6 wherein each of said plurality of contacts includes a retention tang originating on the side of said common extremity of said beam-type members opposite to that of said tail section, and extending generally along a longitudinal axis in the same direction as that of said last mentioned members.

8. A connector as defined in claim 7 further characterized in that a plurality of contact release plates, oriented side by side in a common plane, are utilized in the connector.

9. A connector as defined in claim 8 wherein said cover includes a plurality of selectively positioned standoffs formed on its outer surface to prevent the latter from coming into complete surface contact with the pin-attaching surface of said integrated circuit package.

10. A connector as defined in claim 9 further characterized in that all of said arcuately contoured finger extensions are adapted to intimately engage the surface of integrated circuit package interface pins having a circular cross-section when said contact release plate is in said "closed" position.

* * * * *